US006845227B2

(12) United States Patent
Nishino et al.

(10) Patent No.: US 6,845,227 B2
(45) Date of Patent: Jan. 18, 2005

(54) PRINT MEDIUM FEED SYSTEM

(75) Inventors: Akinori Nishino, Fukushima-ken (JP); Totsuya Kitabatake, Fukushima-ken (JP); Hiroaki Ono, Fukushima-ken (JP); Yasuo Noda, Fukushima-ken (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/722,420

(22) Filed: Nov. 28, 2003

(65) Prior Publication Data

US 2004/0126162 A1 Jul. 1, 2004

(30) Foreign Application Priority Data

Nov. 29, 2002 (JP) ..... 2002-347197

(51) Int. Cl.[7] ..... G03G 15/00
(52) U.S. Cl. ..... 399/406; 400/579; 400/630
(58) Field of Search ..... 399/18, 390, 395, 399/406; 271/161, 184, 185, 188, 209; 400/579, 596, 630

(56) References Cited

U.S. PATENT DOCUMENTS 4,990,011 A * 2/1991 Underwood et al. ..... 400/636
5,144,385 A * 9/1992 Tani ..... 399/406
5,246,224 A * 9/1993 Matsuno et al. ..... 271/242
5,555,083 A * 9/1996 Kuo et al. ..... 399/406
5,920,751 A * 7/1999 Chow et al. ..... 399/97
6,185,403 B1 * 2/2001 Toyoshima et al. ..... 399/365

* cited by examiner

*Primary Examiner*—Ren Yan
(74) *Attorney, Agent, or Firm*—Takeuchi & Takeuchi

(57) ABSTRACT

A print medium feed system comprises a pair of first print medium feed members for feeding a print medium to a print section, a print medium detection section for detecting the print medium, a second print medium feed member for feeding the print medium to the first print medium feed members, and a control section for controlling the first and second print medium feed members. According to the detection by the print medium detection section, the second print medium feed member transports the print medium by a first predetermined distance in the feed direction, then, the first print medium feed members transport the print medium in the feed direction by a second predetermined distance in the feed direction, and then transport the print medium by a third predetermined distance in a backward direction opposite to the feed direction.

15 Claims, 11 Drawing Sheets

FIG. 9
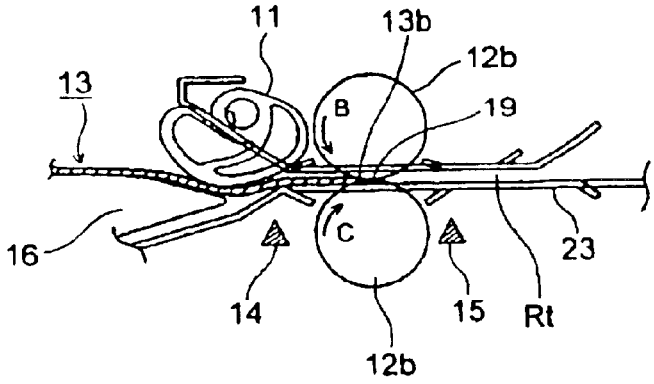
FIG. 10
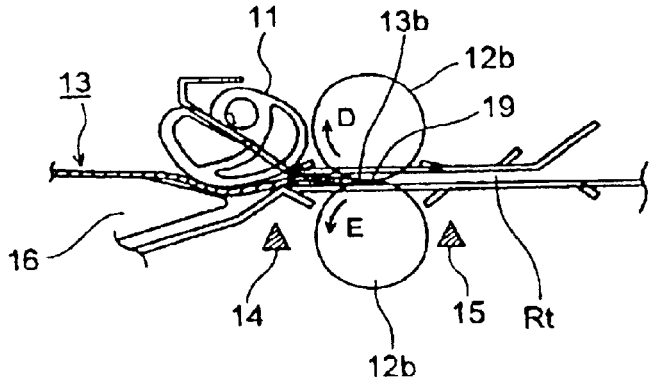
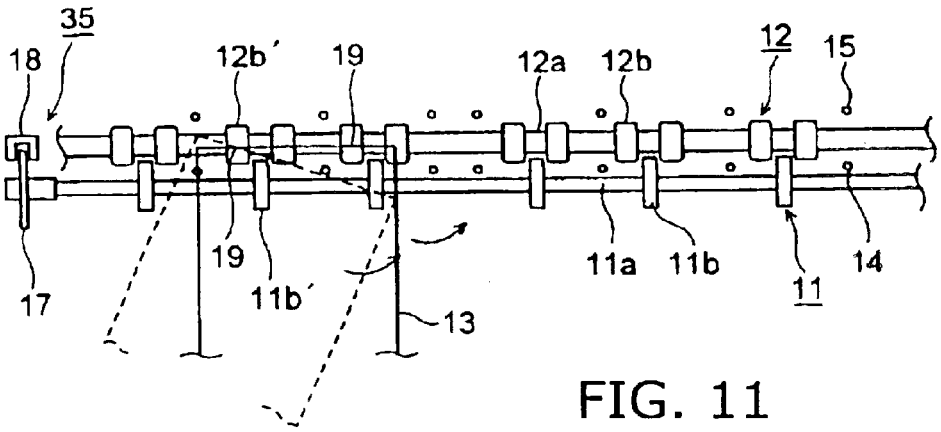
FIG. 11

PRINT MEDIUM FEED SYSTEM

BACKGROUND OF THE INVENTION

1. Field of the Invention

This invention relates to a print medium feed system for feeding a print medium for an image forming unit, such as a printer, copying machine, and facsimile.

2. Description of the Related Art

A print medium feed system is provided in an image forming unit, such as a printer, copying machine, and facsimile, to feed a print medium, such as paper, to a print section. When a print medium is fed to the print section from the print medium feed system, it is possible that the print medium has been skewed. If the print medium is fed to the print section in a skewed condition, the print medium is transported in the skewed condition in the print section too. Under the condition, print is skewed on the print medium, which results in poor printing quality of the image forming unit. Accordingly, a slip roller is rotatably provided in front of the print section to correct the skew of the print medium.

FIG. 3 is a top view of a conventional print medium feed system, showing the operation thereof. FIG. 2 is a sectional view of FIG. 3 taken along with the line A—A, showing a main part of the print medium feed system.

In FIGS. 2 and 3, reference numeral 21 denotes a print head and 22 is a platen, which is rotatably provided and opposed to the print head 21. A print section P1 is provided between the print head 21 and the platen 22. Reference numeral 23 is a first guide for guiding a print medium 13, 24 is a second guide which is spaced from the first guide 23 at a predetermined distance and guides the print medium 13. A transport route Art is formed between the first and second guides 23 and 24 to transport the print medium 13 to the print section P1.

A pair of feed rollers 12 are rotatably provided on the upstream side of the print section P1 in a transport direction of the print medium 13. The print medium 13 is transported by rotating the feed rollers 12. Each of the feed rollers 12 is composed of a shaft 12*a* and a plurality of roller members 12*b* provided on the shaft 12*a* in the axial direction of the shaft 12*a*. A plurality of table sensors 14 are provided under a table 16 on the upstream side of the feed rollers 12 in the transport direction the print medium 13. A plurality of skew sensors 15 are provided under the table 16 on the downstream side of the feed rollers 12.

A slip roller 11 is provided on the upstream side of the feed rollers 12 and the table sensors 14 in the transport direction of the print medium 13. The slip roller 11 is rotatably provided on the side of the second guide 24 with respect to the transport route Rt and faces the transport route Rt. The slip roller 11 is composed of a shaft 11*a* and a plurality of roller members 11*b* provided on the shaft 11*a* in the axial direction of the shaft 11*a*.

When the print medium 13 is set on the table 16 such that the print medium 13 is overlapped with at least one of the roller members 11*b*, the table sensors 14 detect the set print medium 13 and sends a detection signal to a control section (not shown).

When the control section reads the detection signal, it drives a skew correction motor (not shown), rotates the slip roller, and transports the print medium 13. At this point, the feed rollers are stopped.

As the print medium 13 is transported, the front end (an upper side in FIG. 3) of the print medium 13 abuts against a contact point of a certain roller member 12*b*′ of the feed rollers 12. The respective roller members 11*b* are disposed at positions corresponding to those of the respective roller members 12*b*. Accordingly, when the front end of the print medium 13 abuts against the contact point of the certain roller member 12*b*′, a roller member 11*b*′ corresponding to the roller 12*b*′ slips with respect to the print medium 13 afterwards. Consequently, the roller member 11*b*′ does not transport the print medium 13. At this point, the roller members 11*b* other than the roller member 11*b*′ continue the transportation of the print medium 13.

When the front end of the print medium 13 abuts against contacts of the respective roller members 12*b* one after another, the respective roller members 11*b* corresponding to the roller members 12*b* slip with respect to the print medium 13. Accordingly, the respective roller members 11*b* stop transporting the print medium 13.

As described above, the skew of the print medium is corrected. The roller members 11*b* are made of a flexible rubber material to slip sufficiently with respect to the print medium 13. Also, the pressure of the slip roller 11 against the print medium is adjusted.

After the sip roller 11 rotates at a predetermined travelling amount, which is more than the distance between the slip roller 11 and the feed roller 12, the control section sends a drive signal to a line feed motor (not shown) to drive the line feed motor.

After the skew correction is finished, the feed rollers 12 transport the print medium 13. As the print medium 13 is transported, the front end of the print medium 13 arrives at the skew sensors 15. The respective skew sensors 15 detect the arrival and send medium detection signals to the control section. The control section reads in the respective detection signals, detects the difference in detection times on right and left sides of the print medium, and judges if the difference in detection time exceeds a threshold. When the difference exceeds the threshold, the control section judges that the skew has not been corrected and drives the line feed motor in the opposite direction. Then, the feed rollers 12 are rotated in the opposite direction to expel the print medium 13 in the left-hand direction in FIG. 2.

When the difference is less than the threshold, the control section judges that the skew has been corrected and continues driving the line feed motor. Consequently, the feed rollers 12 are rotated in the feed direction so that the print medium 13 is supplied to the print section P1. Then, print is performed in the print section P1.

In the conventional print medium feed system, however, as shown in FIG. 6, when the front end of the print medium 13 is curled, even if the front end 13*b* of the print medium 13 is pressed to the feed roller 12 by the rotation of the slip roller 11, the front end 13*b* does not abuts against a contact point 19 of the roller member 12*b* occasionally. That is, the front end 13*b* of the print medium 13 is transported upwardly along the roller members 12*b* instead of abutting against them. Consequently, the transportation of the print medium 13 fails so that the jam of the print medium occurs. Also, the correction of the skew is not performed surely.

BRIEF SUMMARY OF THE INVENTION

Accordingly, it is an object of this invention to provide a print medium feed system capable of preventing the transportation error of the print medium and performing the skew correction surely.

According to the invention, a print medium feed system comprises a pair of first print medium feed members for feeding a print medium to a print section, a print medium detection section provided on the upstream side of the first print medium feed members and detecting the print medium, a second print medium feed member provided on the upstream side of the print medium detection section and feeding the print medium to the first print medium feed members, and a control section for controlling the first and second print medium feed members.

According to the detection by the print medium detection section, the control section makes the second print medium feed member transport the print medium by a first predetermined distance in the feed direction, and then, makes the first print medium feed members transport the print medium in the feed direction by a second predetermined distance in the feed direction, and then, makes the first print medium feed members transport the print medium by a third predetermined distance in a backward direction opposite to the feed direction.

BRIEF DESCRIPTION OF THE DRAWINGS

FIG. 9 is a sectional view of the print medium feed system according to the first embodiment of the invention, showing the third condition thereof.

FIG. 10 is a sectional view of the print medium feed system according to the first embodiment of the invention, showing the fourth condition thereof.

FIG. 11 is a top view of the print medium feed system according to the first embodiment of the invention, showing an operation of a skew correction thereof.

DESCRIPTION OF THE PREFERRED EMBODIMENT (First Embodiment)

Embodiments of the invention will now be described below with reference to the accompanying drawings. A printer will be described as an image forming apparatus.

Figure 1:
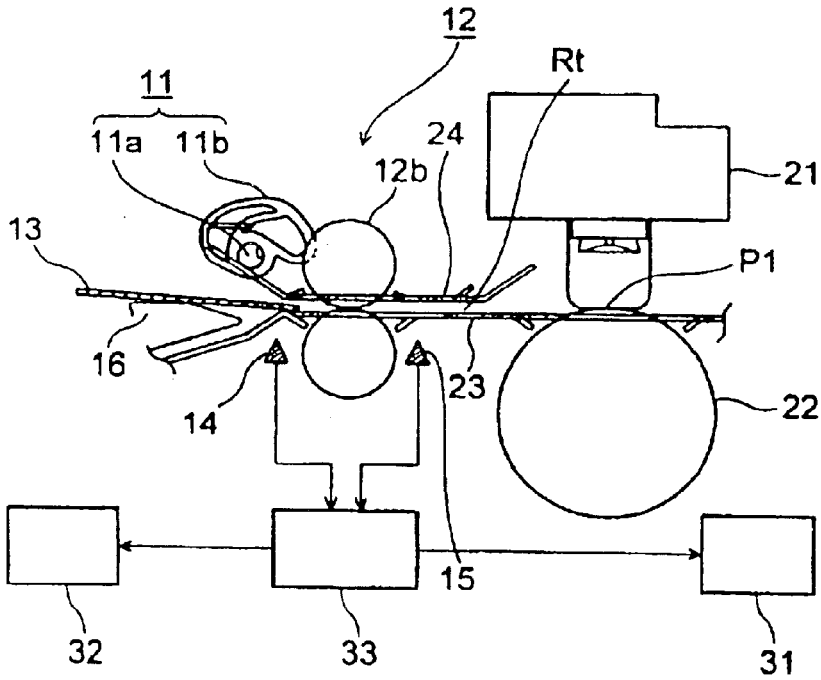
FIG. 1 is a schematic view of a print medium feed system according to the first embodiment of the present invention taken along with the line B—B of FIG. 4.
Figure 2:
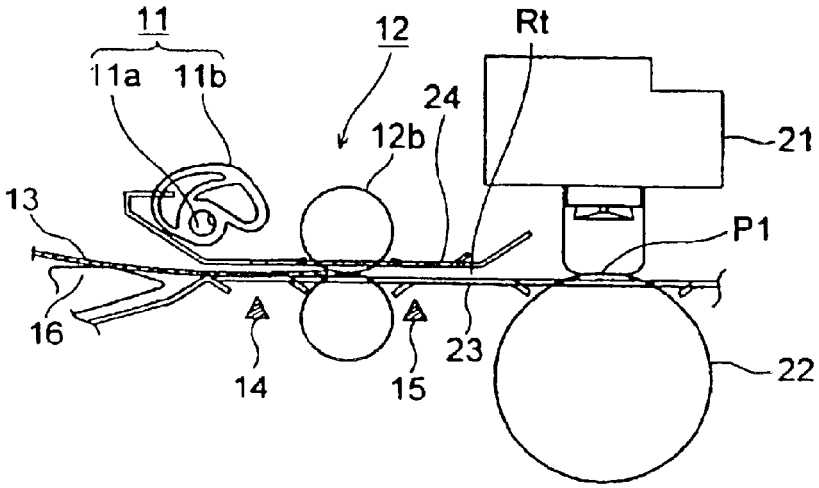
FIG. 2 PRIOR ART
FIG. 2 is a schematic view of a conventional print medium feed system taken along with the line A—A.
Figure 3:
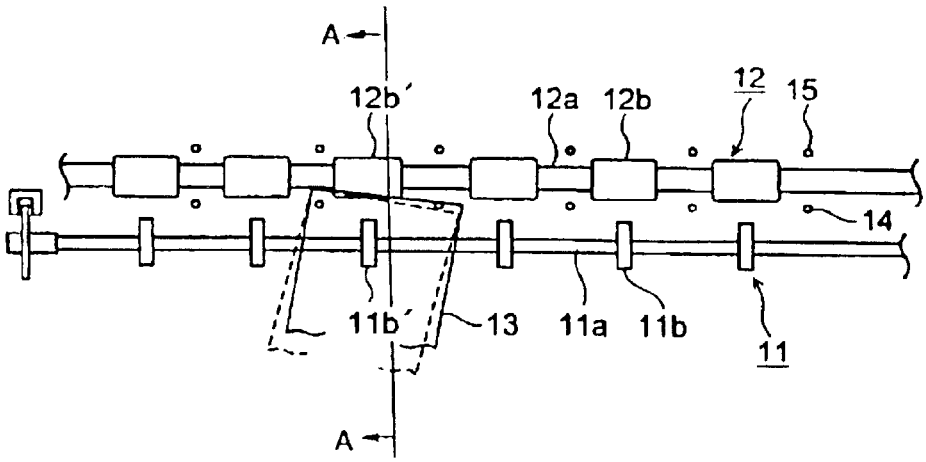
FIG. 3 PRIOR ART
FIG. 3 is a top view of the conventional print medium feed system, showing an operation thereof.
Figure 4:
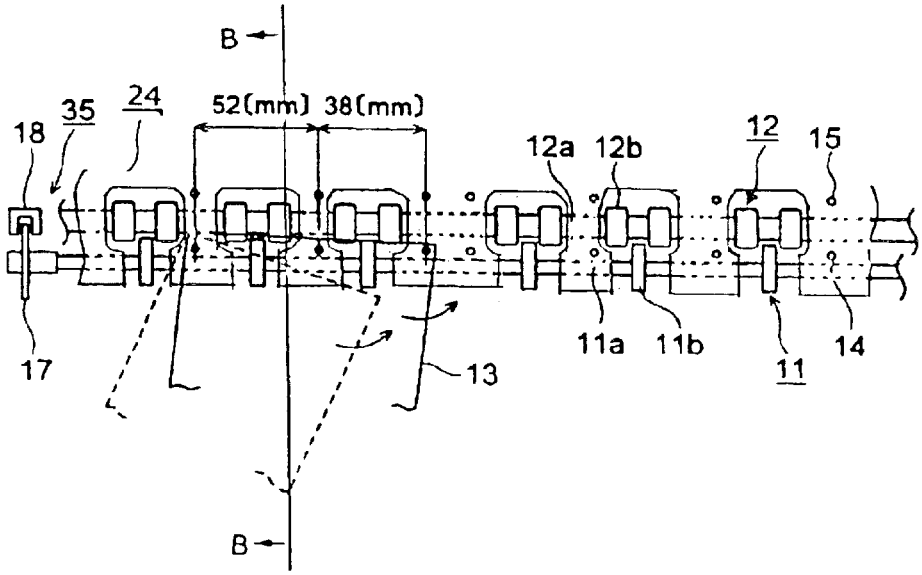
FIG. 4 is a top view of the print medium feed system according to the first embodiment of the invention, showing an operation thereof.
Figure 5:
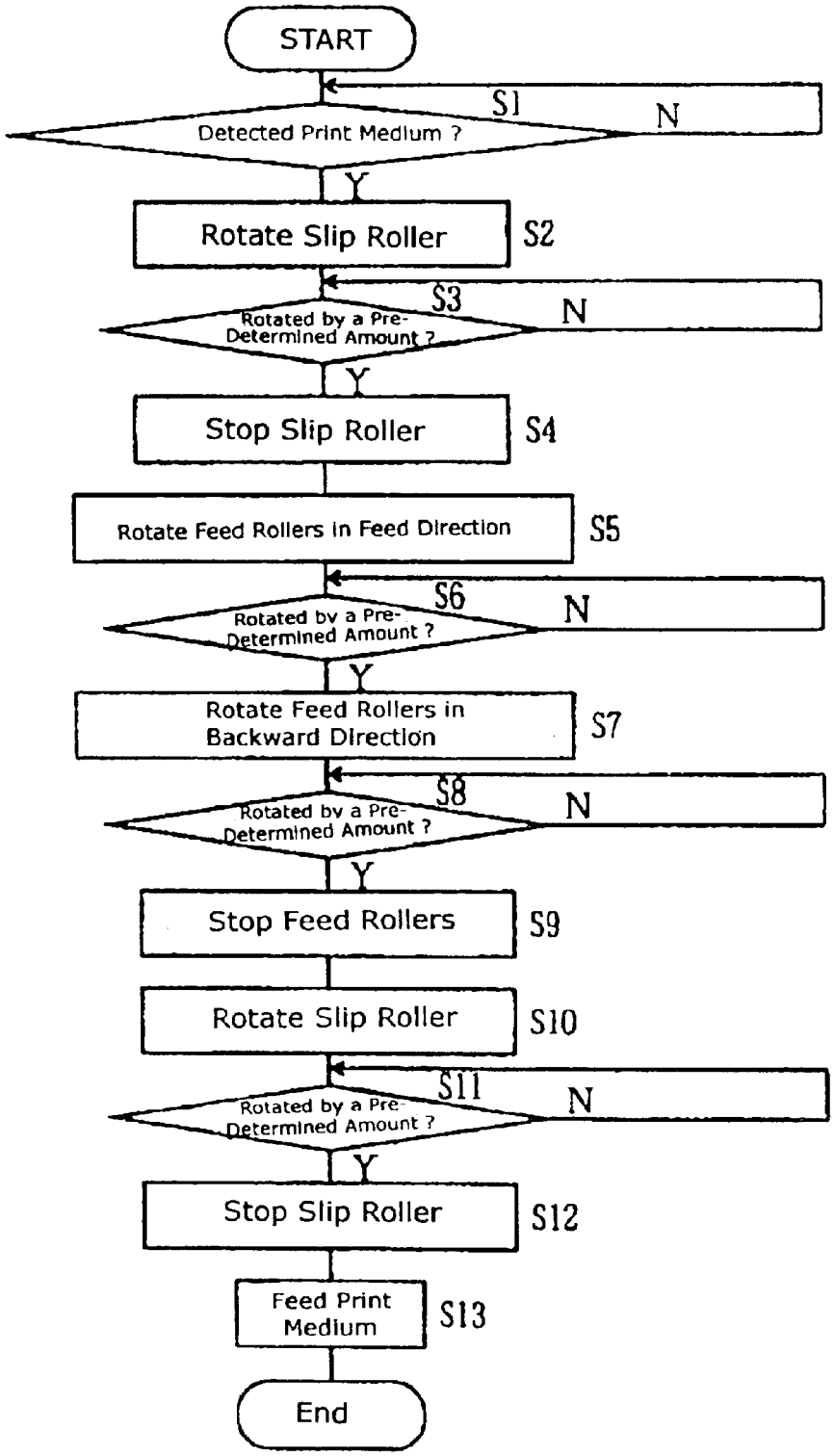
FIG. 5 is a flow chart, showing an operation of the print medium feed system according to the first embodiment of the invention.

In FIGS. 1 and 4, reference numeral 21 denotes a recording device or a print head, 22 denotes is a platen rotatably provided and opposed to the print head 21. A print section P1 is provided between the print head 21 and the platen 22. Reference numeral 23 is a first guide for guiding a print medium 13, 24 is a second guide which is spaced from the first guide 23 at a predetermined distance and guides the print medium 13. A transport route Rt is formed between the first and second guides 23 and 24 to transport the print medium 13 to the print section P1.

A pair of first print medium feeders or feed rollers 12 are rotatably provided on the upstream side of the print section P1 in a transport direction of the print medium 13. The feed rollers 12 are rotated by a drive section or a line feed roller (LF) 31. The print medium 13 is transported to the print section P1 by the rotation of the feed rollers 12. Each of the feed rollers 12 is composed of a shaft 12*a* and a plurality of roller members 12*b* provided on the shaft 12*a* in the axial direction of the shaft 12*a*. A plurality of detection sections for detecting the print medium or table sensors 14 are provided under a table 16 on the upstream side of the feed rollers 12 in the transport direction the print medium 13. When the table sensors 14 detect the print medium 13, the table sensors 14 send detection signals to a control section 33. A plurality of detection sensors for detecting the skew or skew sensors 15 are provided under the table 16 on the downstream side of the feed rollers 12 at positions substantially corresponding to those of the table sensors 14 in the widthwise direction of the table 16. The skew sensors 15 detect the print medium 13 and generate detection signals for reporting the condition of the print medium 13 to send them to the control section 33. The control section 33 receives the detection signals from a plurality of skew sensors 15 and calculates the differences in the respective detection times. Here, the pitches between the table sensors 14 and the skew sensors 15 are two kinds, 38 mm and 52 mm. When a postcard (100 mm×148 mm) is set as the print medium 13, two table sensors 14 or more detect the print medium 13.

A second print medium feeder and skew correction roller, or a slip roller 11 is provided on the upstream side of the feed rollers 12 and the table sensor 14 in the transport direction of the print medium 13. The slip roller 11 is rotatably provided on the side of the second guide 24 with respect to the transport route Art and faces the transport route Rt. The slip roller 11 is rotated by driving a drive section for the skew correction or a skew correction motor (MS) 32. When the slip roller 11 is rotated, the print medium 13 is transported to the feed rollers 12. The slip roller 11 is composed of a shaft 11*a* and a plurality of roller members 11*b* provided on the shaft 11*a* in the axial direction of the shaft 11*a*. The slip roller 11 is made in the form of substantially "D" so that the slip roller 11 can take two conditions; an evaded condition for running off the transportation route Rt and a working condition for working out the skew correction.

A rotation detector for detecting the rotation amount of the slip roller 11 or a rotation sensor 35 is provided at an end of the slip roller 11. The rotation sensor 35 is composed of a slit 17 attached to an end of the shaft 11*a* and a sensor 18 provided at a predetermined position of the printer and facing the slit 17.

The operation of the print medium feed system will now be described.

When the print medium 13 is set on the table 16 such that the print medium 13 is overlapped with at least one of the roller members 11*b* of the slip roller 11, the table sensor 14 detects that the print medium 13 is set, and sends detection signals to the control section 33.

FIGS. 6–11 and 20 show the operation and conditions of the first embodiment of the invention.

Figure 6:
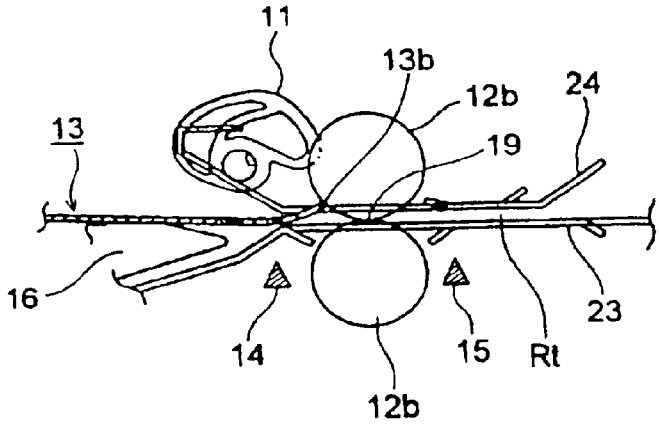
FIG. 6 is a sectional view of the print medium feed system according to the first embodiment of the invention, showing the first condition thereof.

In FIG. 6, when the control section 33 is waiting for the insertion of the print medium 13, the slip roller 11 is put in an evaded position in the rotation direction thereof so that the slip roller 11 does not interfere with the transportation of the print medium 13. When the slip roller 11 is in the evaded position, the slip roller 11 is spaced from the transportation route Art by a predetermined distance so that no friction is produced between the print medium 13 and the slip roller 11 upon the insertion of the print medium 13. Accordingly, the print medium 13 is easily inserted.

Figure 7:
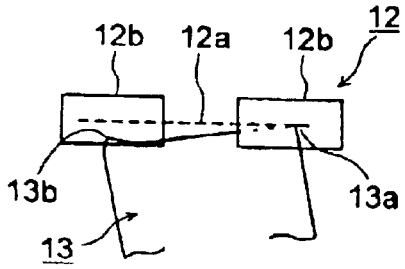
FIG. 7 is a top view of the print medium feed system according to the first embodiment of the invention, showing the first condition thereof.

As shown in FIGS. 6 and 7, when either front right end 13*a* or front left end 13*b* of the print medium 13 is curled, for example, when the front left end 13*b* is curled, if such a print medium 13 is inserted between the first and second guides 23 and 24, a skew can occur. Accordingly, a pre-correction means (not shown) in the control section 33 (FIG. 1) performs pre-correction with the following procedures.

Figure 8:
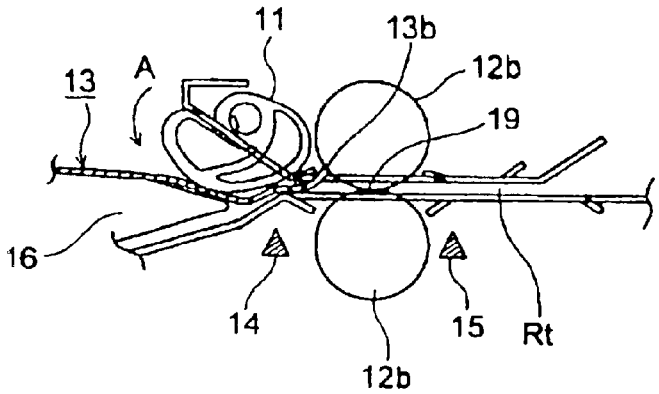
FIG. 8 is a sectional view of the print medium feed system according to the first embodiment of the invention, showing the second condition thereof.
Figure 12:
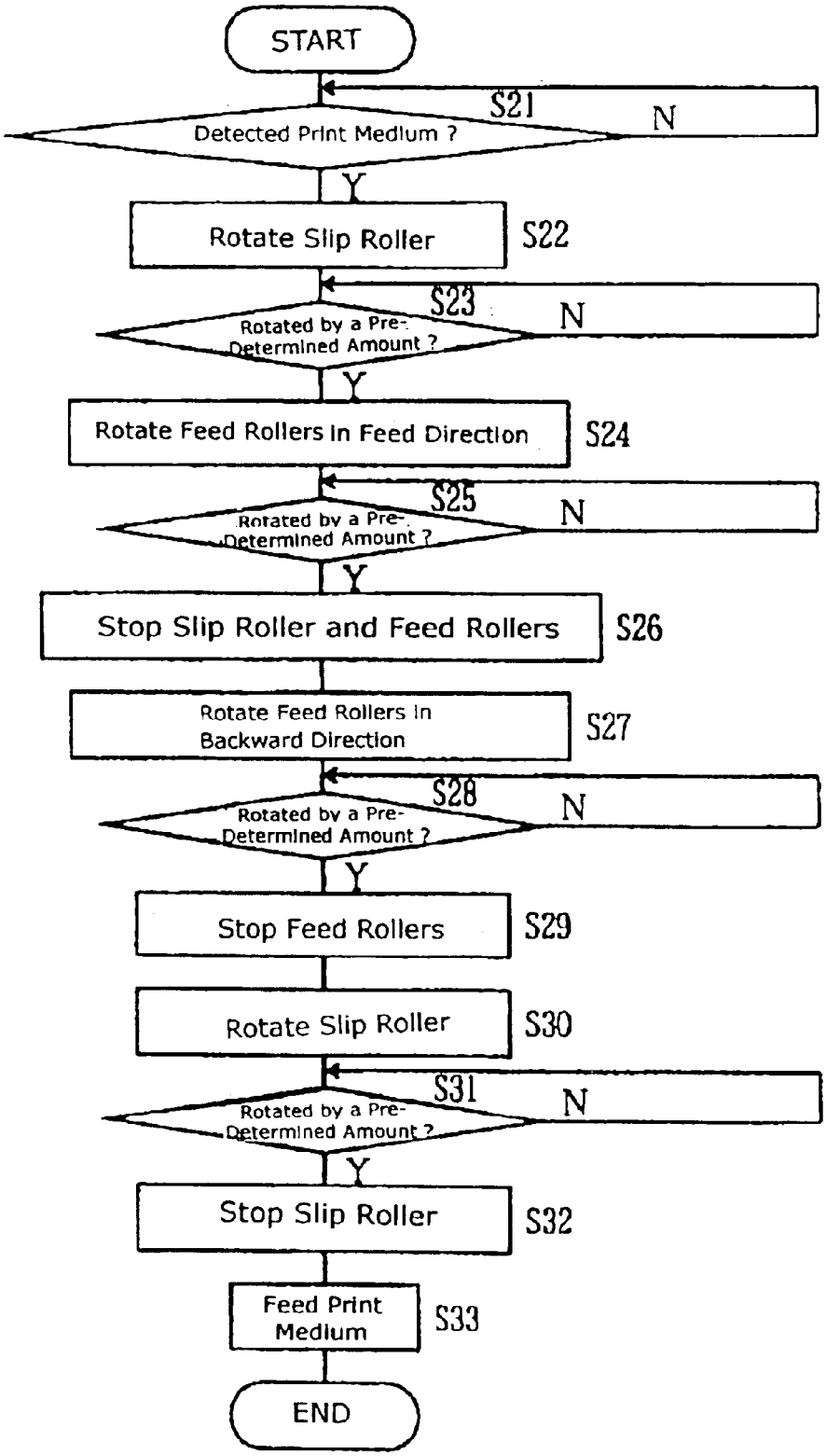
FIG. 12 is a flow chart, showing an operation of a print medium feed system according to the second embodiment of the present invention.

As shown in FIG. 8, the pre-correction means rotates the slip roller 11 by driving the skew correction motor 32 by a predetermined amount in the direction of an arrow A. In this embodiment, the slip roller 11 is rotated by an amount of 1.5 rotations, which is substantially equal to such an amount of the transportation of the print medium 13 that the print medium 13 is warped by a predetermined amount after the front left end 13*b* of the print medium 13 abuts against the feed roller 12. The slip roller 11 stops after transporting the print medium 13 by the predetermined amount. Here, the rotation sensor 35 (FIG. 4) detects the amount of the rotation of the sip roller 11 and sends rotation detection signals to the control section 33. A rotation control means (not shown) in the control section 33 performs rotation control. The rotation control is to calculate the number of pulses in accordance with the rotation detection signals and controls the skew correction motor 32 in accordance with the calculated number of pulses.

At this point, since the feed rollers 12 are not moving, as the print medium 13 is transported, the front right end 13*a* of the print medium 13, which is not curled, abuts against a contact point 19 of the roller member 12*b*. However, the front left end 13*b*, which is curled, does not abut against the contact point 19 but abut against the surface of the roller member 12*b* so that the vicinity of the front left end 13*b* waves.

In this embodiment, the slip roller 11 is rotated by 1.5 rotations in the pre-correction process. At this point, however, if at least two tables sensors 14 do not detect the print medium 13, the pre-correction means judges that the print medium 13 is skewed largely and rotates the slip roller 11 by 1.5 rotations again. Afterward, if at least two table sensors 14 do not detect the print medium 13 again, an error-judgment means (not shown) in the control section 33 performs error-judgment. The error-judgment is to judge the setting-error of the print medium 13 and indicate the occurrence of the error on a display section (not shown).

Then, as shown in FIG. 9, while the print medium 13 is held by the slip roller 11, the pre-correction means drives the line feed motor 31 in the forward direction so as to rotate the feed rollers 12 by a predetermined amount in the paper-feed direction (the directions of arrows B and C for the roller members 12*b*). The front left end 13*b*, which is abutting against the roller members 12*b*, is guided to the contact point 19 by the friction with the roller members 12*b*, and then stopped. The front right end 13*a* passes between the roller members 12*b* and the front left end 13*b* enters between the roller members 12*b* at the position of the contact point 19. As the vicinity of the front left end 13*b*, which waves, enters between the roller members 12*b*, the waves are smoothed out. During this moment, the pre-correction means stops the drive of the skew correction motor 32 to stop the slip roller 11. Consequently, the transportation of the print medium 13 is stopped, and the print medium 13 is pressed to the first guide 23 by the slip roller and held by the first guide 23. In this embodiment, the line feed motor 31 is driven by 16 pulses so that the amount of the transportation of the print medium 13 by the rotation of the feed rollers 12 is as small as 2.26 mm, which is substantially equal to the amount of the transportation enabling the curled part of the print medium 13 to be guided to the contact point 19 of the feed rollers 12.

Next, as shown in FIG. 10, the pre-correction means drives the line feed motor 31 in backward direction so as to rotate the feed roller 12 by a predetermined amount in the backward direction (the directions of arrows of D and E for the roller members 12*b*). The print medium 13 is transported by a predetermined distance in the backward direction, and then stopped. At this point, the slip roller 11 is not moving. Consequently, the front end of the print medium 13, which has entered between the roller members 12*b*, comes off the feed rollers 12. The backward movement of the print medium 13 is a little so that it is impossible that the front left end 13*b* is curled upwardly along the roller member 12*b* again.

Figure 21A:
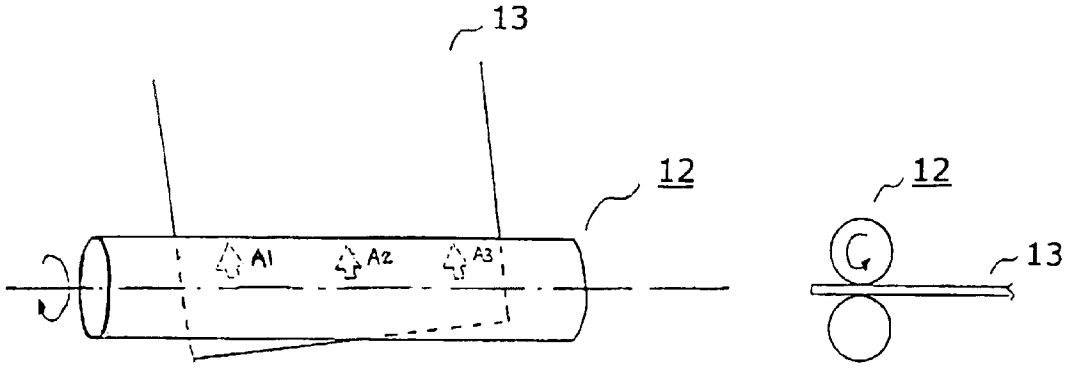
FIGS. 21(*a*)-(*c*) are top views of a feed roller according to the first embodiment of the invention, showing an opposite-direction transportation.
Figure 21B:
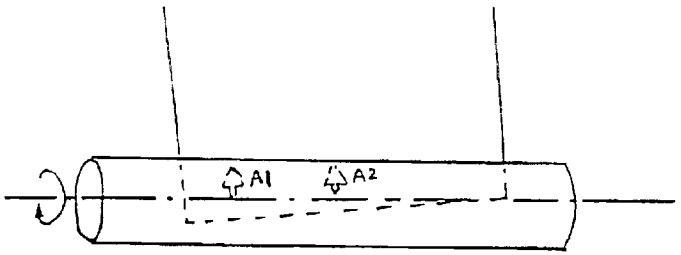
Figure 21C:
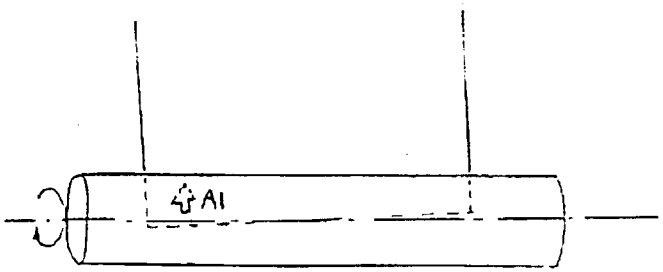

The reason why the front left end 13*b* is not curled and does not abut against the roller members 12*b* will be described below with reference to FIG. 21. FIG. 21(*a*) shows the status where the print medium 13 is starting to move backward by the backward rotation of the feed rollers 12, FIG. 21(*b*) shows the status where the print medium 13 is in the way of the backward movement, and FIG. (c) shows the status where the print medium 13 is finishing the backward movement. In FIG. 21(*a*), the print medium 13 receives backward force from the feed rollers 12 in the entire width thereof so that the whole part of the print medium 13 moves backward. In FIG. 21(*b*), the right side of the sheet in the drawing is separated from the feed roller 12 so that the backward force at that part is lost and only the left side and center of the sheet are moved. Since the sheet is held by the slip roller 11, the right side does not move and keeps the same position. In FIG. 21(*c*), the right side and center of the sheet are separated from the feed roller 12 so that the backward force at those parts is lost and only the left side is moved. Since the print medium 13 is held by the slip roller 11, the right side and center do not move and keep the same positions. Finally, the left side is also separated from the feed roller 12 so that the backward force at that part is lost. Consequently, the whole parts of the print medium 13 stop moving and keep the position so that the curled front left end 13*b* does not return up to the position shown in FIG. 6. That is, the curled front left end 13*b* stops moving at the position shown in FIG. 10, therefore, it is prevented that the curled front left end 13*b* is curled upwardly along the roller member 12*b* again.

In this embodiment, the line feed motor 31 is driven by 20 pulses so that the amount of the transportation (movement) of the print medium 13 by the backward rotation of the feed rollers 12 is as small as 2.82 mm. That is, the amount of the backward rotation of the feed roller 12 is made larger than that of the forward rotation (rotation in the paper-feed direction) of the feed roller 12. Here, since the line feed motor 31 is driven forwardly and then backwardly, the actual amount of backward rotation of the feed roller 12 is two pulses smaller than that by 20 pulses due to the back lash of gears (not shown) provided between the line feed motor 31 and the feed roller 12.

Next, a skew correction means (not shown) in the control section 33 performs skew correction. That is, the skew correction means drives the skew correction motor 32 so as to rotate the slip roller 11 by a predetermined amount. The skew correction means transports the print medium 13 to the feed roller 12 to correct the skew, and then stop it.

In FIG. 11, as the print medium 13 is transported by the rotation of the slip roller 12, the front end of the print medium 13 shown in the dotted line abuts against the contact point 19 of a certain roller member 12'. The respective roller members 11*b* are disposed at positions corresponding to those of the respective roller members 12*b*. Accordingly, when the front end of the print medium 13 abuts against the contact point 19 of the certain roller member 12*b'*, a roller member 11*b'* corresponding to the roller 12*b'* slips with respect to the print medium 13 afterwards. Consequently, the roller member 11*b'* does not transport the print medium 13.

At this point, the roller members 11*b* other than the roller member 11*b'* continue the transportation of the print medium 13. When the front end of the print medium 13 abuts against contact points 19 of the respective roller members 12*b* one after another, the respective roller members 11*b* corresponding to the roller members 12*b* slip with respect to the print medium 13. Accordingly, the respective roller members 11*b* stop transporting the print medium 13.

Thus, the skew of the print medium 13 is corrected as shown in the solid line in FIG. 11. The roller members 11*b* are made of a flexible rubber material to slip sufficiently with respect to the print medium 13. Also, a rubber part of the slip role 11 is made hollow so that the change in the pressure of the slip roller 12 against the print medium 13 according to the thickness of the print mediums 13 is minimized. That is, when the thick print mediums 13 is inserted, the rubber part is crushed so that the pressure against the print mediums 13 is reduced. Consequently, even if the thickness of the mediums is changed, the slip roller 11 presses the print mediums 13 at substantially constant pressure so that the transportation force is not changed. Even when a plurality of kinds of print mediums 13 having different thicknesses are used, the stable transportation of the print medium 13 is obtained.

After the skew is corrected, the skew correction means brings the slip roller 11 to the evaded position. Afterwards, a paper feed means (not shown) in the control section 33 performs paper feed. Namely, the paper feed means sends drive signals to the line feed motor 31 to drive the line feed motor 31. Consequently, the feed rollers 12 rotate to transport the print medium 13 in the direction of the print section P1. The slip roller 11 may be brought to the evaded position after the paper feed is started. In this case, even when the print medium 13 is pushed in the left direction in FIG. 9 by the rotation of the feed rollers 12, the slip roller 11 pushes back the print medium 13 toward the feed rollers 12. Accordingly, such a transportation error that the print medium 13 is not transported forwardly because of the pushed-back movement caused by the backward rotation of the feed rollers 12.

As the print medium 13 is transported by the feed rollers 12, the skew sensors 15 detect the print medium 13 and send detection signals to the control section 33. A skew judgment means (not shown) in the control section 33 performs skew judgement. That is, the skew judgement means reads the respective detection signals and calculates the difference in detection times. The skew judgement means judges if the difference in detection time exceeds a threshold. When the difference exceeds the threshold, the skew judgement means judges that the skew has not been corrected and when the difference is less than the threshold, the skew judgement means section judges that the skew has been corrected.

In case that the first skew correction cannot correct skew sufficiently (the difference in detection times exceeds the threshold), the skew judgement means drives the line feed motor 31 in the backward direction again to rotate the feed rollers 12 in the backward direction by a predetermined amount. When the print medium 13 is separated from the feed rollers 12 after the backward transportation by a predetermined amount, the skew judgement means drives the skew correction motor 32 to rotate the slip roller 11 by a predetermined amount (in this embodiment, an amount of 0.5 rotation). Then, the print medium 13 is transported forwardly to correct skew. The same procedure is repeated for the skew correction until the detection difference becomes less than the threshold. Every time the skew correction is repeated, the amounts of the forward (paper-feed direction) and backward rotations of the feed rollers 12 are made large. If necessary, the rotation speed and rotation amount of the feed rollers 12 may be changed every time the skew correction is repeated. When the number of the repeat of the skew correction becomes three, the skew judgment means judges the error of the skew correction occurred and indicates the occurrence of the error on the display section.

When the skew correction is finished (the detection difference is equal to or less than the threshold), the paper feed means drives the line feed motor 31 to rotate the feed rollers 12 for paper feed. Then, the print medium 13 is fed to the print section P1 for printing.

On the other hand, when the skew judgment means judges that skew did not occur, the paper feed means continues driving the line feed motor 31 to rotate the feed rollers 12 for paper feed. Then, the print medium 13 is fed to the print section P1 for printing.

As described above, since the feed rollers 12 rotate in the feed direction, while the front end of the print medium 13 is abutting against the feed roller 12, even when a certain part of the front end of the print medium 13 is curled, the print medium 13 is made flat and the front end of the print medium 13 can be guided to the contact point 19. Consequently, the transportation error of the print medium 13 is prevented and the skew of the print medium 13 is corrected surely.

Also, since the print medium 13 moves back and forth every time the skew correction is repeated, the print medium 13 is vibrated, which enables more certain skew correction of the print medium 13.

In this embodiment, the slip roller 11 is rotated by an amount of 0.5 rotation to perform the skew correction after the feed rollers 12 are rotated in the backward direction by a predetermined amount for separating the print medium 13 from the feed rollers 12. The rotation amount of the slip roller 11, however, may be changed in accordance with the detection difference. For example, when the detection difference is 3 mm or less, the rotation amount of the slip roller 11 is made 0.5 rotation, and when the detection difference is more than 3 mm, the rotation amount is made 1.5 rotations.

The flow chart will now be described.

Step S1: Wait until the medium detection sensor 14 detects the print medium 13, while the slip roller 11 is in the evaded position. When the medium detection sensor 14 detects the print medium 13, go to the step S2.

Step S2: Rotate the slip roller 11.

Step S3: Wait until the slip roller 11 is rotated by a predetermined amount. Go to the step S4, when the slip roller 11 is rotated by the predetermined amount.

Step S4: Stop the rotation of the slip roller 11 under the condition that the slip roller 11 holds the print medium 13.

Step S5: Rotate the feed rollers 12 in the feed direction.

Step S6: Wait until the feed rollers 12 are rotated by a predetermined amount. Go to the step S7 when the feed rollers 12 are rotated by the predetermined amount.

Step S7: Rotate the feed rollers 12 in the backward direction.

Step S8: Wait until the feed rollers 12 are rotated by a predetermined amount. Go to the step S9 when the feed rollers 12 are rotated by the predetermined amount.

Step S9: Stop the rotation of the feed rollers 12.

Step S10: Rotate the slip roller 11.

Step S11: Wait until the slip roller 11 is rotated by a predetermined amount. Go to the step S12 when the slip roller 11 is rotated by the predetermined amount.

Step S12: Stop the rotation of the slip roller 11 under the condition that the slip roller 11 releases the print medium 13.

Step S13: Feed the print medium 13 by the feed rollers 12 and finish the process.

As fully described above, according to the invention, a print medium feed system comprises a pair of first print medium feed members for feeding a print medium to a print section, a print medium detection section provided on the upstream side of the first print medium feed members and detecting the print medium, a second print medium feed member provided on the upstream side of the print medium detection section and feeding the print medium to the first print medium feed members, and a control section for controlling the first and second print medium feed members.

According to the detection by the print medium detection section, the control section makes the second print medium feed member transport the print medium by a first predetermined distance in the feed direction, and then, makes the first print medium feed members transport the print medium.

Here, the second print medium feed member transports the print medium until the print medium abuts against the first print medium feed member and warped. Then, the first print medium feed members transport the print medium so that even if a certain portion of the front end of the print medium is curled, the print medium can be certainly transported to the first print medium feed members. Also, the curled portion of the print medium can be made flat by the first print medium feed members. Consequently, the transportation error of the print medium can be prevented and the skew of the print medium is surely corrected.

(Second Embodiment)

The second embodiment of the invention will now be described. The structure of a print medium feed system according to the second embodiment is identical to that of the first embodiment and will be described with reference to FIG. 1.

The print medium 13 is set on the table 16 such that the print medium 13 is overlapped with at least one of the roller members 11*b* of the second print medium feeder or the slip roller 11. The print medium detection section or the table sensors 14 detect that the print medium 13 is set and send detection signals to the control section.

Figure 13:
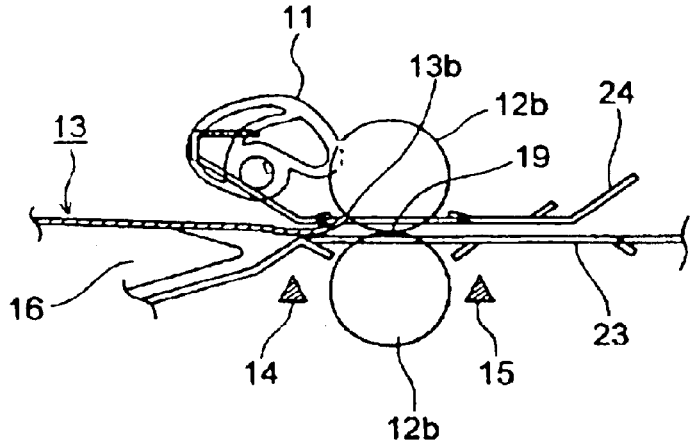
FIG. 13 is a sectional view of the print medium feed system according to the second embodiment of the invention, showing the first condition thereof.
Figure 14:
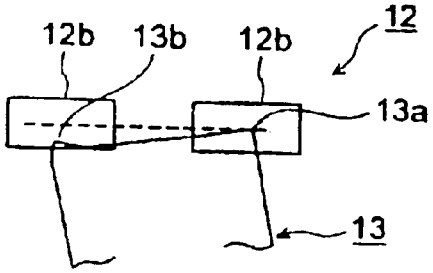
FIG. 14 is a top view of the print medium feed system according to the second embodiment of the invention, showing the first condition thereof.

As shown in FIGS. 13 and 14, when either front right end 13*a* or front left end 13*b* of the print medium 13 is curled, for example, when the front left end 13*b* is curled, if such a print medium 13 is inserted between the first and second guides 23 and 24, a skew can occur.

Figure 15:
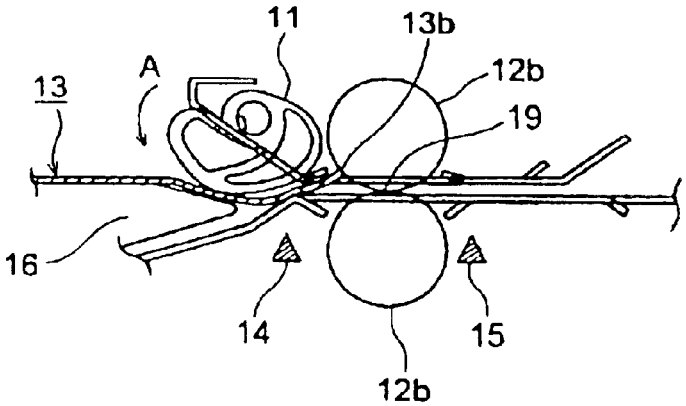
FIG. 15 is a sectional view of the print medium feed system according to the second embodiment of the invention, showing the second condition thereof.
Figure 16:
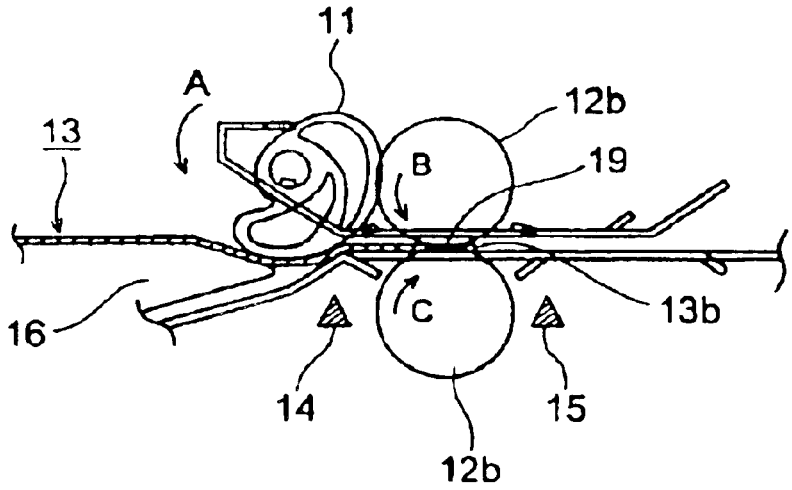
FIG. 16 is a sectional view of the print medium feed system according to the second embodiment of the invention, showing the third condition thereof.

Accordingly, a pre-correction means in the control section 33 performs pre-correction. That is, the pre-correction means drives the skew correction motor 32 and as shown in FIG. 15, rotates the slip roller 11 in the direction of arrow A. The print medium 13 is transported in the paper-feed direction by the rotation of the slip roller 11 and the front left end 13*b* abuts against the roller member 12*b*. In FIG. 16, the pre-correction means continues transporting the print medium 13 by rotating the slip roller 11 in the direction of the arrow A. While rotating the slip roller 11, the pre-correction means drives the line feed motor 31 in the forward direction to rotate the first print medium feeder or the feed rollers 12 by a predetermined amount in the paper-feed direction (the directions of the arrows B and C for the roller members 12*b*). The front left end 13*b*, which has abutted against the roller member 12*b*, is guided to the contact point 19 by the friction with the roller members 12*b*. After the front left end 13*b* entered between the roller members 12*b*, the rotations of the slip and feed rollers 11 and 12 are stopped.

Figure 17:
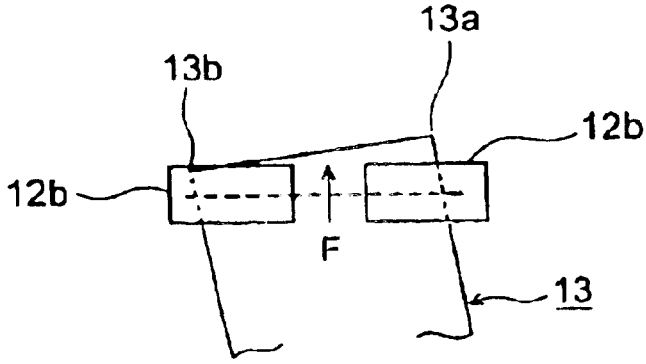
FIG. 17 is a top view of the print medium feed system according to the second embodiment of the invention, showing the third condition thereof.

As shown in FIG. 17, during the time, the print medium 13 is transported in the direction of an arrow F (the upward direction in FIG. 17). The front right end 13*a* passes between the respective roller members 12*b* and the front left end 13*b* enters between the respective roller members 12*b* at the position of the contact point 19. Accordingly, the waved portion in the vicinity of the front left end 13*b* is stretched by the roller members 12*b*. In this embodiment, the line feed motor 31 is driven by the amount of 50 pulses and the transportation amount of print medium 13 in the paper-feed direction by the rotation of the-feed rollers 12 is made equal to the maximum curl amount or 7 mm.

As the print medium 13 is transported, the skew condition detection section or the skew sensors 15 detect the print medium 13 and send condition detection signals to the control section 33. The skew judgement means performs skew judgement by reading the respective condition detection signals and calculate the difference in the detection times. When the detection difference (difference in the detection times) exceeds the threshold, the skew judgement means judges that skew has occurred, and when the detection difference is equal to or less than the threshold, the skew judgement means judges that skew has not occurred.

Figure 18:
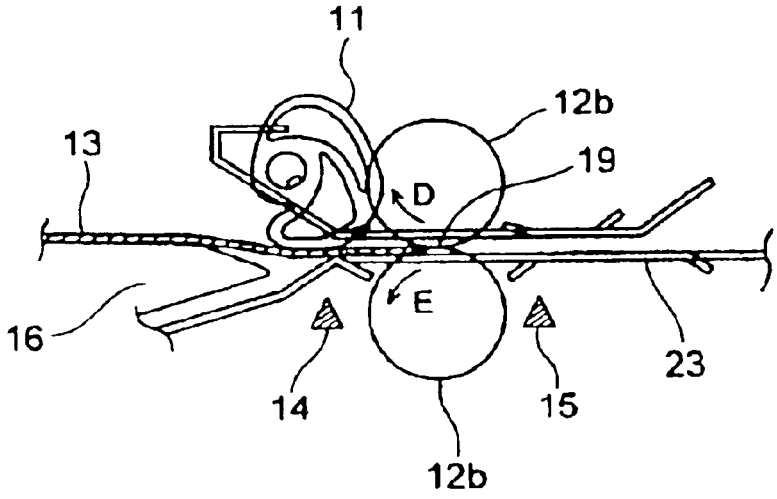
FIG. 18 is a sectional view of the print medium feed system according to the second embodiment of the invention, showing the fourth condition thereof.

When it is judged in the skew judgement process that skew has occurred, the skew correction means in the control section 33, as shown in FIG. 18, performs the skew correction again by driving the line feed motor 31 in the backward direction to rotate the feed rollers 12 in the backward direction (the direction of the arrows D and E for the roller members 12*b*) by a predetermined amount. Accordingly, the front end of the print medium 13 is transported in the backward direction and comes off the roller members 12*b*. The transportation amount of the print medium 13 is a little so that it is impossible that the front left end 13*b* is curled upwardly along the roller members 12*b* again.

In this embodiment, the line feed motor 31 is driven by the amount of 100 pulses and the transportation amount of the print medium 13 by the rotation of the feed rollers 12 in the backward direction is made 14 mm. Namely, the amount of backward rotation of the feed rollers 12 is made twice the amount of the rotation of the feed rollers 12 in the paper-feed direction.

On the other hand, when it is judged that skew has nor occurred, the paper feed means continues driving the line feed motor 31 to rotate the feed rollers 12 for feeding the print medium 13. Then, the print medium 13 is fed to the print section P1 for printing. During the paper feeding process, the slip roller 11 is disposed at the evaded position. Accordingly, the transportation load caused by the friction between the print medium 13 and the slip roller 11 is reduced so that the stable transportation of the print medium 13 is enabled.

When the line feed motor 31 is driven in the backward direction to rotate the feed rollers 12 in the backward direction, as shown in FIG. 18, the rotation of the slip roller 11 is stopped and the print medium 13 is pressed against the first guide 23 by the slip roller 11. Accordingly, the backward force from the feed rollers 12 is applied to the print medium 13 so that the front left end of the print medium 13 retreats and comes off the contact point 19 to be released from the feed rollers 12 before the front right end 13*a* does the same thing. When the front left end 13*b* is separated from the roller members 12*b*, the backward force is lost so that the front left end 13*b* remains at the position by the friction with the slip roller 11.

During the time, the front right end 13*a* retreats, and then, comes off the contact point 10 to be released from the feed rollers 12. When the front right end 13*a* is separated from the roller members 12*b*, the front right end 13*a* remains at the position by the friction with the slip roller 11.

Figure 19:
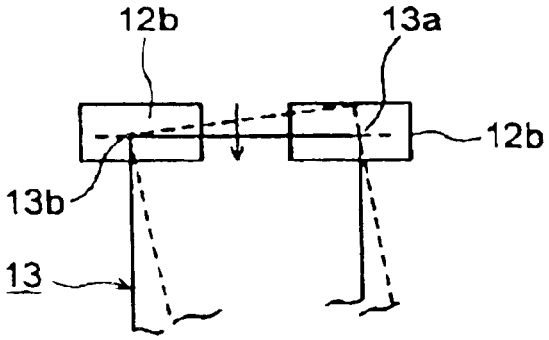
FIG. 19 is a top view of the print medium feed system according to the second embodiment of the invention, showing the fourth condition thereof.
Figure 20:
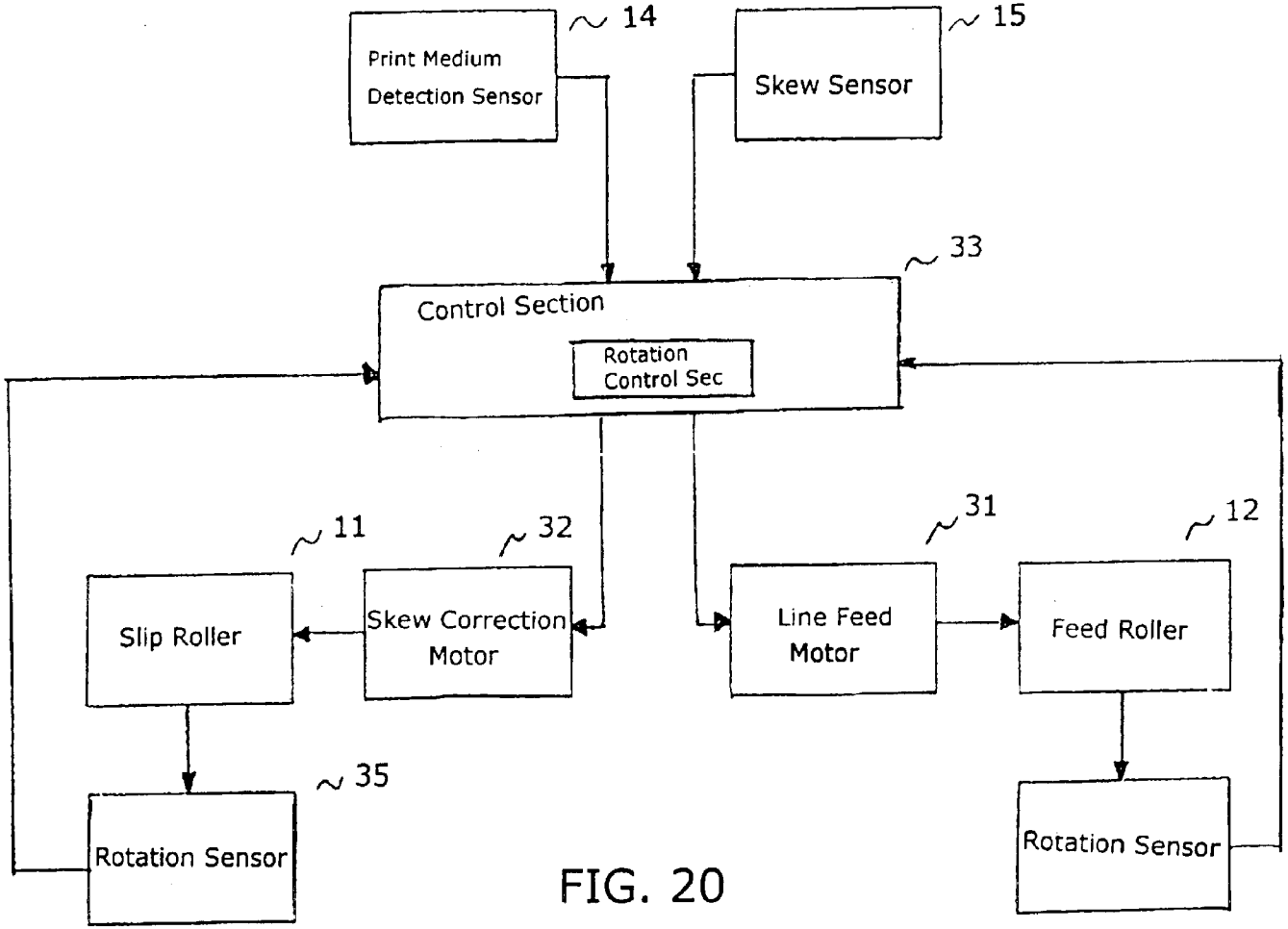
FIG. 20 is a block diagram of the print medium feed system according to the first embodiment of the invention, showing a control operation.

Consequently, as shown in FIG. 19, the front right and left ends 13*a* and 13*b* are stopped at the positions where they come off the contact point 19 and skew is corrected.

Next, the skew correction means drives the skew correction motor 32 to rotate the slip roller 11 by a predetermined amount. The print medium 13 is transported by the rotation of the slip roller 11 for further skew correction and stopped after skew is corrected.

Then, the paper feed means in the control section 33 performs paper feed by sending driving signals to the line feed motor 31 to drive the line feed motor 3 so that the feed rollers 12 are rotated and the print medium 13 is transported.

As the print medium 13 is transported, the skew sensors 15 detect the print medium 13 again and send detection signals to the control section 33. The skew judgement means reads the respective detection signals and judges again if skew still occurs. When the detection difference exceeds the threshold, that is, skew has not been corrected sufficiently in the first skew correction, the skew correction means drives the line feed motor 31 in the backward direction to rotate the feed rollers 12 in the backward direction by a predetermined amount so that the print medium 13 is transported in the backward direction and the front end of the print medium 13 comes off the roller members 12*b*.

At this point, the rotation of the slip roller 11 is stopped and the print medium 13 is pressed against the first guide 23 so that skew is corrected.

The skew correction procedure is repeated until the detection difference becomes equal to or less than the threshold. Every time the skew correction is repeated, the amounts of the rotation of the feed rollers 12 in the paper-feed and backward directions increase. Also, if necessary, every time the skew correction is repeated, the speed and amount of the rotation of the feed rollers 12 may be changed.

When the skew correction is finished, that is, when the detection difference becomes equal to or less than the threshold, the skew correction means brings the slip roller 11 to the evaded position and the paper feed means drives the line feed motor 31. Consequently, the feed rollers 12 are rotated to feed the print medium 13 to the pint section P1 for printing.

As described above, the slip roller 11 is rotated to make the front end of the print medium 13 abut against the feed roller 12 and the feed rollers 12 are rotated in the paper-feed direction, while the slip roller 11 is rotating. Accordingly, the curled portion of the print medium 13 can be made flat. Also, the transportation error of the print medium 13 can be prevented. Accordingly, when the print medium 13 retreats by the backward rotation of the feed rollers 12, the skew of the print medium 13 can be corrected certainly.

The flow chart will now be described.

Step S21: Wait until the medium detection sensor 14 detects the print medium 13. When the medium detection sensor 14 detects the print medium 13, go to the step S2.

Step S22: Rotate the slip roller 11.

Step S23: Wait until the slip roller 11 is rotated by a predetermined amount. Go to the step S24, when the slip roller 11 is rotated by the predetermined amount.

Step S24: Rotate the feed rollers 12 in the paper-feed direction to transport the print medium 13, working together with the slip roller 11.

Step S25: Wait until the feed rollers 12 are rotated by a predetermined amount. Go to the step S26 when the feed rollers 12 are rotated by the predetermined amount.

Step S26: Stop the rotations of the slip roller 11 and the feed rollers 12.

Step S27: Rotate the feed rollers in the backward direction, while the slip roller 11 holds the print medium 13.

Step S28: Wait until the feed rollers 12 are rotated by a predetermined amount. Go to the step S29 when the feed rollers 12 are rotated by the predetermined amount.

Step S29: Stop the rotation of the feed rollers 12.

Step S30: Rotate the slip roller 11.

Step S31: Wait until the slip roller 11 is rotated by a predetermined amount. Go to the step S32 when the slip roller 11 is rotated by the predetermined amount.

Step S32: Stop the rotation of the slip roller 11.

Step S33: Feed the print medium 13 by the rotation of the feed rollers 12 and finish the process.

In the respective embodiments, the horizontal-type printer, in which the paper feed is performed in the horizontal direction. The invention, however, may be applicable to such a printer as has a paper feed section (paper inserter) capable of receiving the print medium from above. In the printer with the inserter, cutform is set into the inserter from above and rollers provided in the inserter has the same functions as the feed rollers have.

The present invention is not limited to the embodiments and a plurality of variations are possible in the concept of the invention, and therefore, the variations should not be excluded from the scope of the invention.

What is claimed is:

1. A print medium feed system, comprising:

first print medium feed members for feeding a print medium feed to a print section;

a print medium detection section provided on the upstream side of said first print medium members in a feed direction of said print medium and making detection of said print medium;

a second print medium feed member provided on the upstream side of said print medium detection section in said feed direction and feeding said print medium to said first print medium feed members; and a control section for controlling said first and second print medium feed members, wherein according to said detection of said print medium by said print medium detection section, said control section, firstly, makes said second print medium feed member transport said print medium by a first predetermined distance in said feed direction, secondly, makes said first print medium feed members transport said print medium by a second predetermined distance in said feed direction, and thirdly, makes said first print medium feed members transport said print medium by a third predetermined distance in a backward direction which is opposite to said feed direction.

2. The print medium feed system according to claim 1, wherein said control section makes said second print medium feed member stop transporting said print medium while said first print medium feed members are transporting said print medium by said second predetermined distance.

3. The print medium feed system according to claim 1, wherein said control section makes said second print medium feed member continue transporting said print medium while said first print medium feed members are transporting said print medium by said second predetermined distance.

4. The print medium feed system according to claim 1, wherein said second predetermined distance of said transportation of said print medium by said first print medium feed members is made small.

5. The print medium feed system according to claim 1, wherein said second predetermined distance of said transportation of said print medium by said first print medium feed members is made equal to a maximum size of a curl of said print medium.

6. The print medium feed system according to claim 1, wherein said second print medium feed member does not press said print medium while said first print medium feed members are transporting said print medium in said print medium feed direction by said second predetermined distance.

7. The print medium feed system according to claim 1, wherein said second print medium feed member presses said print medium while said first print medium feed members are transporting said print medium in said print medium direction by said second predetermined distance.

8. The print medium feed system according to claim 1, wherein said third predetermined distance of said transportation of said print medium in said backward direction is made larger than said second predetermined distance in said print medium feed direction.

9. The print medium feed system according to claim 1, wherein said control section performs skew correction after said first print medium feed members transport said print medium in said backward direction.

10. The print medium feed system according to claim 9, wherein when said control section makes said first print feed members feed said print medium to said print section after finishing said skew correction, said second print medium feed member does not press said print medium.

11. The print medium feed system according to claim 9, wherein when said control section makes said first print feed members feed said print medium to said print section after finishing said skew correction, said second print medium feed member presses said print medium.

12. The print medium feed system according to claim 1, wherein said second print medium feed member is a roller having a shape of substantially D.

13. The print medium feed system according to claim 1, wherein said second print medium feed member is a roller which is made of a rubber part having at least one hollow.

14. The print medium feed system according to claim 1, wherein said print medium detection section is composed of a plurality of print medium detection sensors.

15. The print medium feed system according to claim 1, wherein said second print medium feed member is provided at a position corresponding to positions of said first print medium feed members.

* * * * *